United States Patent [19]

Romer et al.

[11] Patent Number: 4,619,201

[45] Date of Patent: Oct. 28, 1986

[54] GRADUATED-DENSITY PACKED PROPELLANT CHARGE

[75] Inventors: Rudolf Romer, Kaarst; Michael Schwenzer, Duesseldorf; Reinhard Synofzik, Juelich, all of Fed. Rep. of Germany

[73] Assignee: Rheinmetall GmbH, Duesseldorf, Fed. Rep. of Germany

[21] Appl. No.: 648,798

[22] Filed: Sep. 7, 1984

[30] Foreign Application Priority Data

Sep. 7, 1983 [DE] Fed. Rep. of Germany ..... 3332224

[51] Int. Cl.[4] ..... C06D 5/06

[52] U.S. Cl. ..... 102/283; 102/292; 264/3.1

[58] Field of Search ..... 102/283, 285, 286, 290, 102/292, 293; 264/3 R, 3.1

[56] References Cited

U.S. PATENT DOCUMENTS

| | | | |
|---|---|---|---|
| 654,471 | 7/1900 | Maxim | 102/286 |
| 726,901 | 5/1903 | Gathmann | 102/286 |
| 802,347 | 10/1905 | Aspinwall | 102/292 |
| 2,995,011 | 8/1961 | Kimmel | 102/285 |
| 4,331,081 | 5/1982 | Cloutier et al. | 102/322 X |

*Primary Examiner*—Peter A. Nelson

[57] ABSTRACT

A charge formed of a mass of packed propellant is generally centered on an axis and is of radially generally uniformly and radially outwardly increasing density. This charge has a predetermined size and shape and is made by first filling particulate propellant into a chamber centered on an axis and defined by side walls extending at least generally parallel to the axis. This chamber is radially somewhat larger than the predetermined size and shape for the charge. At least some of the side walls are then displaced radially inward to reduce the volume of the chamber until the reduced chamber generally has the size and shape for the charge. The weight of the particulate propellant filled into the chamber is equal to the desired weight for the charge. The tail of a projectile is positioned in the chamber before filling the particulate propellant into the chamber. The projectile downwardly closes the chamber and can be raised after the mass is packed to push it up out of the chamber.

2 Claims, 5 Drawing Figures

FIG. 2
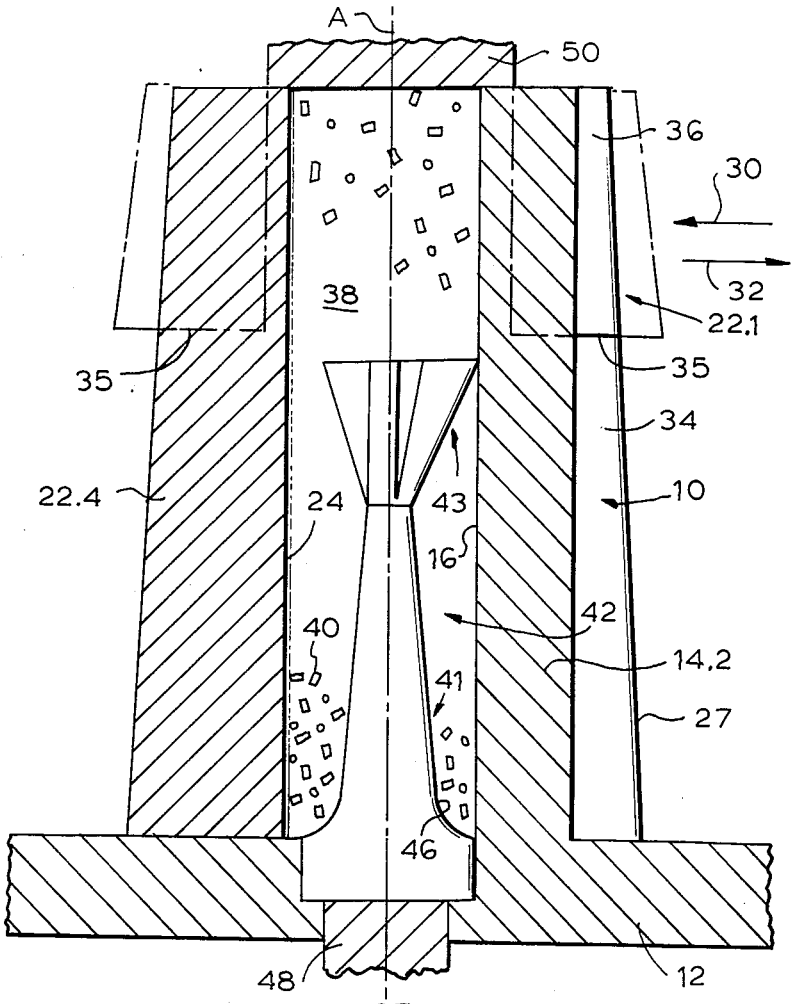
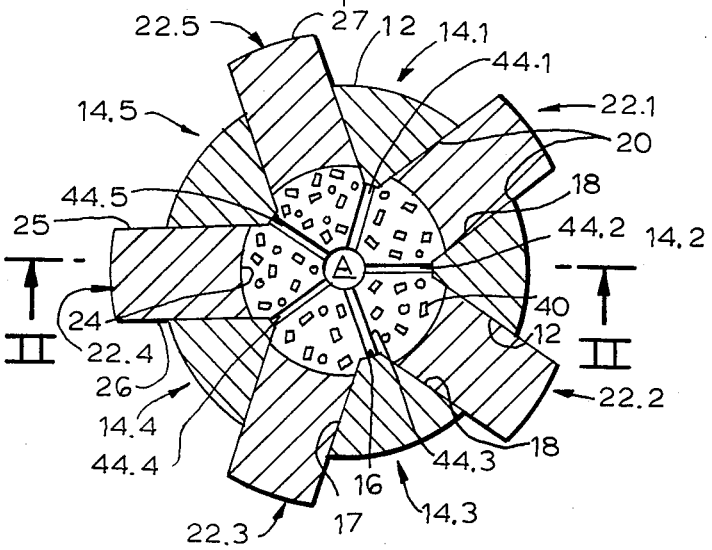
FIG. 1

FIG. 4
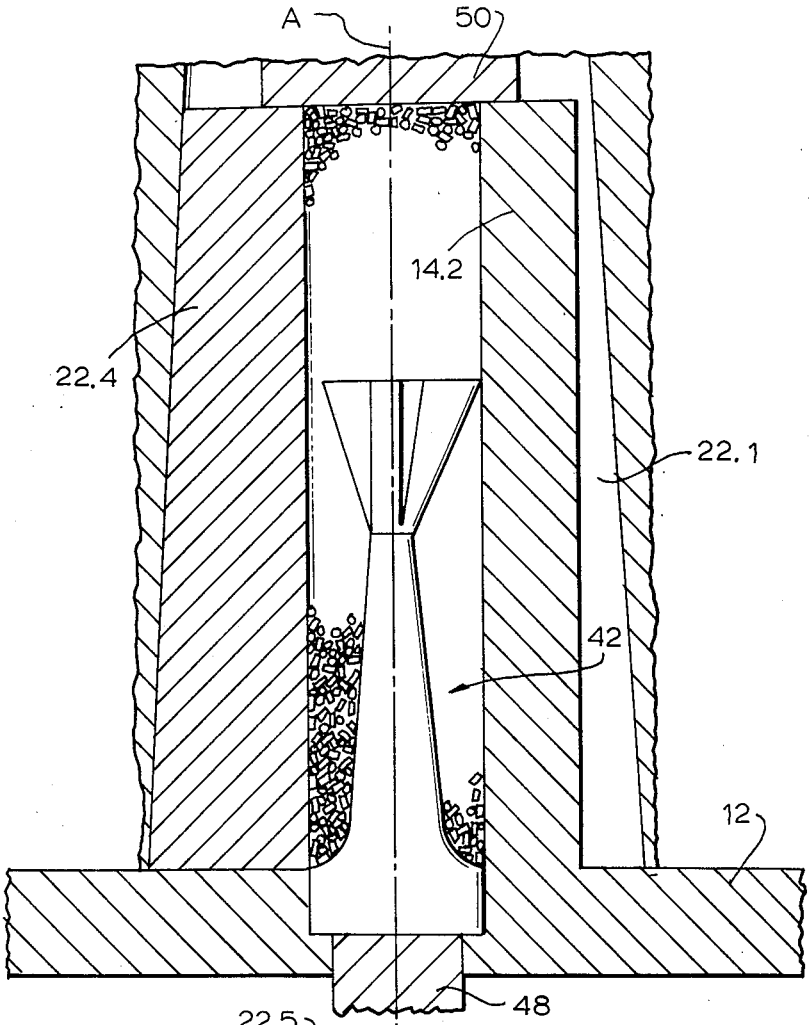
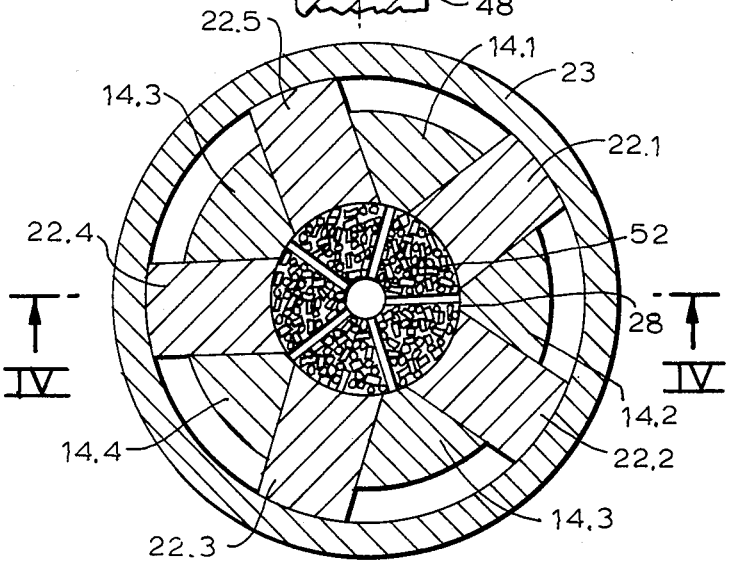
FIG. 3

GRADUATED-DENSITY PACKED PROPELLANT CHARGE

FIELD OF THE INVENTION

The present invention relates to a packed propellant charge. More particularly this invention concerns a propellant charge and method of and apparatus for making same.

BACKGROUND OF THE INVENTION

It is axiomatic in explosives that for maximum explosion force it is necessary to pack the explosive material as tightly as possible into its container, both to maximize the amount of material and to eliminate force-deadening voids. A modified (dense) packing is particularly also important for propellant charges which must give uniform propellant force from projectile to projectile for uniform artillery results.

German patent document No. 2,504,756 describes an arrangement for use as a grenade or propellant charge. In this arrangement the particulate explosive or propellant material is filled into a bottle-like canister and then the mouth of the canister is closed by a fitting which carries an expansible bladder inside the bottle. The interior of the bladder is pressurized while the space inside the canister around the bladder is pumped out, causing the bladder to swell and press against the unpacked mass of explosive or propellant in the canister, exerting enough pressure to pack it tightly therein. After a few such filling and compacting operations the interior of the canister is tightly packed.

This method is relatively cumbersome with its several steps. In addition the charge ends up being packed in stratified layers, as with each packing operation the uppermost layer is packed with a density gradient that increases upward. The explosion of such a stratified charge is nonuniform, and in fact thorough explosion may not take place. The desired explosion of a charge from the center out is not obtained with such an axially stratified charge.

OBJECTS OF THE INVENTION

It is therefore an object of the present invention to provide an improved packed propellant charge.

Another object is the provision of a method of and apparatus for making a packed propellant charge which overcome the above-given disadvantages, that is which make the manufacture of the charge relatively simple and easy while producing a higher-quality product.

SUMMARY OF THE INVENTION

A propellant charge formed of a mass of packed propellant explosive according to this invention is generally centered on an axis and is of radially generally uniformly increasing density. Normally the density of the mass increases radially outward. In addition the mass density can increase axially, that is one end of the mass can be denser than the other.

A propellant charge of a predetermined size and shape is made according to the invention by first filling particulate propellant into a chamber centered on an axis and defined by side walls extending at least generally parallel to the axis. This chamber is radially somewhat larger than the predetermined size and shape for the charge. At least some of the side walls are then displaced radially inward to reduce the volume of the chamber until the reduced chamber generally has the size and shape for the charge. Thus the particulate propellant is packed into a propellant charge whose density increases radially outward from the axis.

Such a propellant charge will ignite and burn off very well, as the less dense core will ignite and burn rapidly, creating a rapid and very uniform development of propelling gases. In addition the charge will be relatively durable, with a hard outer surface.

The method is relatively simple and requires an absolute minimum of steps to carry it out. The actual packing of the propellant is one simple step, which is a vast improvement over the layered packing method described above.

According to this invention the weight of the particulate propellant filled into the chamber is equal to the desired weight for the charge. Thus when a very dense charge is being made, the chamber must merely be opened up enough to start with to receive the entire mass, which will be relatively large when not packed.

Furthermore, before radial inward displacement of the side walls of the chamber, the chamber is of varying horizontal cross section. More specifically, the chamber has an upper region that is of greater horizontal cross section than the underlying lower chamber region.

In accordance with yet another invention feature the tail of a projectile is positioned in the chamber before filling the particulate explosive into the chamber. The projectile in fact downwardly closes the chamber and can be raised after the mass is packed to push it up out of the chamber. The top of the chamber is closed before displacing the side walls radially inward.

The apparatus according to the invention has a mold defining an upwardly open chamber centered on an upright axis and having upright side walls defining an upwardly open chamber. At least some of the side walls are radially displaceable. Particulate material is filled into the chamber. These radially displaceable side walls are then displaced inward to radially reduce the volume of the chamber until the reduced chamber generally has the size and shape for the charge. Thus the particulate propellant packed into a charge whose density increases radially outward from the axis.

The side walls in accordance with this invention include a plurality of angularly spaced like guides and a plurality of radially displaceable pushers interleaved with and slidable between the guides. The guides have angularly directed faces lying in planes parallel to the axis, each face confronting and parallel to the face of the immediately adjacent guide. In addition each guide has a radially inwardly directed face that is part-cylindrical and has a center of curvature at the axis. Similarly each pusher has a radially inwardly directed face that is part-cylindrical and that forms a cylinder centered on the axis when displaced radially inward.

It is also possible according to this invention for each pusher to have an upper part and a lower part movable relative to the upper part. Futhermore, a projectile tail having a plurality of vanes is axially centered in the chamber. The vanes number the same as the guides and each vane radially outwardly engages a respective one of the guides.

DESCRIPTION OF THE DRAWING

The above and other features and advantages will become more readily apparent from the following, reference being made to the accompanying drawing in which:

FIG. 1 is a cross section through the charge-making apparatus according to this invention in the start position;

FIG. 2 is an axial section taken along line II—II of FIG. 1;

FIG. 3 is a view like FIG. 1, but showing the apparatus in the start position;

FIG. 4 is an axial section taken along line IV—IV of FIG. 3; and

SPECIFIC DESCRIPTION

Figure 5:
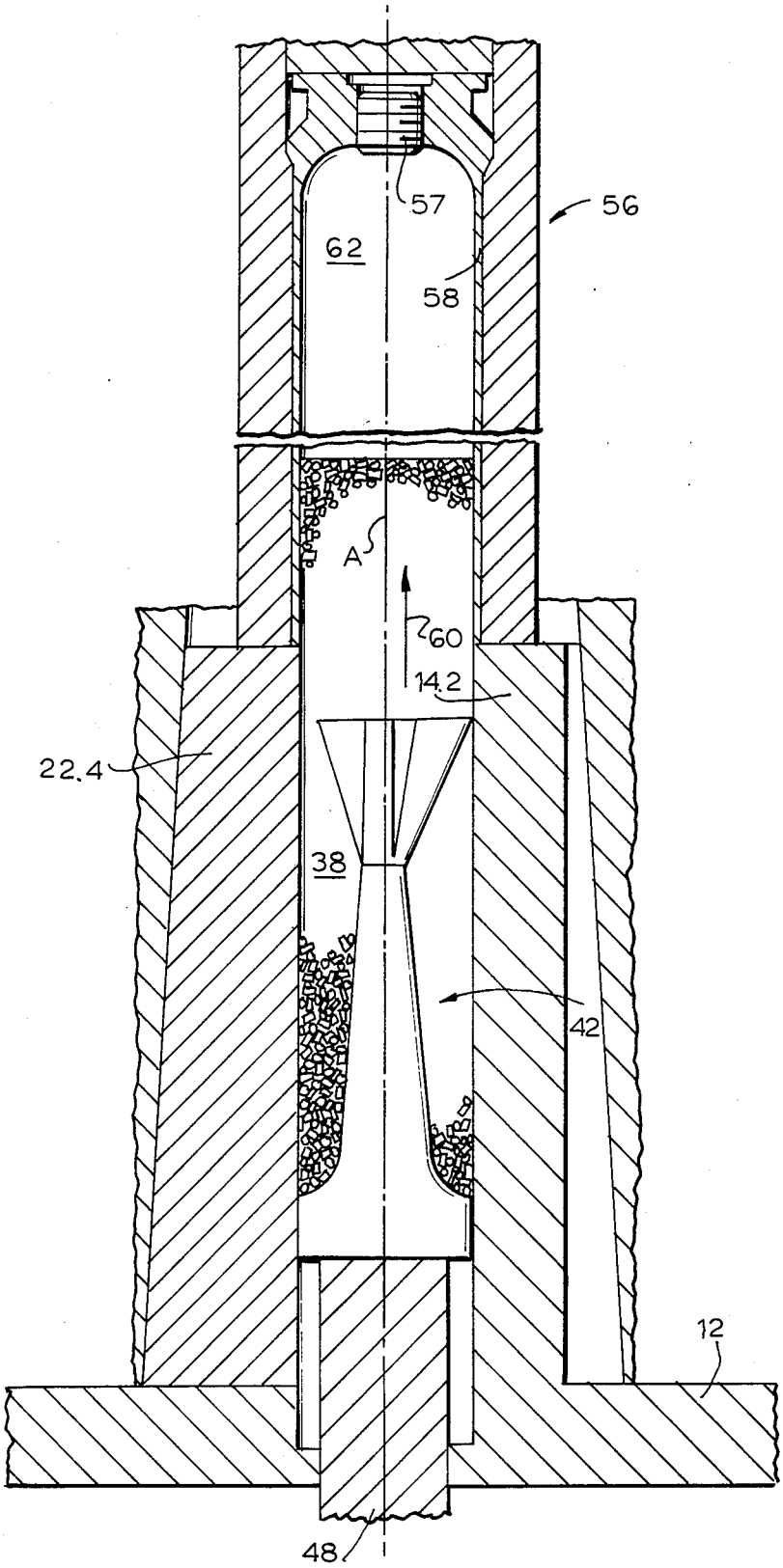
FIG. 5 is an axial section showing a further step in the charge-making process.

As seen in FIG. 1 a mold for making a propellant charge has a stationary frame comprised of a base plate 12 and five generally triangular-section guides 14.1–14.5 projecting upward from it. The guides 14.1–14.5 are all identical and are angularly and radially equispaced about a vertical axis A. Each guide 14.1–14.5 has a pair of flat guide faces 17 and 18 extending at 72° to each other and that lie in respective planes parallel to but offset from the axis A, with confronting faces 17 and 18 being parallel and defining a passage 20. A short part-cylindrical inner surface 16 bridges the axis-parallel inner edges of the faces 17 and 18 and has a center of curvature at the axis A. Outer surfaces 19 of part-cylindrical shape centered on the axis A bridge the outer edges of the faces 17 and 18.

Interleaved between the guides 14.1–14.5 in the guide passages 20 are radially movable pushers 22.1–22.5 having parallel and planar side faces 25 and 26 that engage and slide on the respective faces 18 and 17. The pushers 22.1–22.5 have part-cylindrical inner faces 24 extending parallel to the axis A and of the same radius of curvature as the inner faces 16 of the guides 14.1–14.5. These pushers 22.1–22.5 have outer surfaces 27 that all lie on a common imaginary frustocone centered on the axis A and tapered upward.

The guides 14.1–14.5 and the pushers 22.1–22.5 therefore define the vertical side walls of a chamber 38 centered on the axis A. The top of this chamber 38 is closed by a a removable cover plate 50 and the bottom is plugged by a tail 42 of a projectile 41. This projectile 41 has a rear surface 46 that receives the force of the propellant charge. The tail 42 has a stabilizer 43 formed by five identical and angularly equispaced vanes 44.1–44.5 whose radial outer edges just touch the surfaces 16, perfectly centering the tail 42 in the chamber 38.

In use the cover 50 is moved to the side and the chamber 38 is filled with granular, pulverous, or pelletized propellant 40 which can be shaken in to form a loose mass. During this filling the pushers 22.1–22.5 are in the outer positions shown in FIGS. 1 and 2.

Once filled, the cover 50 is moved back into place atop the guides 14.1–14.5 and a drive sleeve 23 of a frustoconical inner shape complementary to the imaginary frustocone formed by the outer pusher surfaces 27 is forced down over the pushers 22.1–22.5. This forces the pushers 22.1–22.5 radially inward, until their inner faces 24 form with the faces 16 a cylinder 28 centered on the axis A, that is the faces 24 and 16 are flush with one another. This compacts the mass 40 of propellant pellets radially into a compressed charge 50.

Since the propellant mass 40 is compressed radially inward, the mass density will increase radially outward, with the outer surfaces of the charge 51 being more dense and compressed than the inner regions. As a result the core of the thus formed charge 52 will be fairly spongy and easy to ignite, wile maximum propellant effect is achieved by the high-power compacted outer layers.

In order further to graduate the density of the charge it is possible as indicated in FIG. 2 to divide each of the pusher 22.1–22.5 about two-thirds of the way up at a plane 35 perpendicular to the axis A above the stabilizer fins 44.1–44.5 into an upper part 36 and a lower part 34. Before filling the chamber 38, the upper parts 36 are all moved slightly further out than the respective lower parts 34, so the upper portions of the surfaces 24 will be spaced radially further out than the lower portions of these surfaces 24. Movement from this position into the position of FIGS. 3 and 4 will therefore compact the upper portion of the mass 40 more than its lower portion. The result will be a charge whose density varies both radially and axially, being denser at the rear end and outer surfaces than at the front end and in its core.

FIG. 5 illustrates how the charge can then be inserted into the chamber 62 of a cartridge case 58 received in a holder 56 and having a primer 57. To do this the cover 50 is first shifted to the side and the holder 56 with the casing 58 is fitted over the top of the upwardly open chamber 38. A plunger 48 underneath the projectile tail 42 is then raised to press the tail 42 and the mass 52 around it into the lower end of the casing 58.

The inner diameter of the lower end of the casing 58 corresponds to the cylinder 28 and the inner diameter inside the casing 58 decreases thereabove, giving it a slightly frustoconical shape. This ensures that the charge 52 will be tightly packed within this casing and slightly more tightly packed around its rear end.

I claim:

1. In a propellant charge generally centered on an axis, said charge being formed of a mass of fluid propellant consisting of individual grains, the improvement wherein, the propellant charge is arranged such that there is a uniform increase in density from the axis radially outwardly, whereby the average density of the charge exceeds the bulk density of the propellant.

2. The improved charge defined in claim 1 wherein the density of the mass also increases axially.

* * * * *